US008838012B2

(12) United States Patent
Torimaru

(10) Patent No.: US 8,838,012 B2
(45) Date of Patent: Sep. 16, 2014

(54) IMAGE FORMING APPARATUS WITH BELT MEMBER PUSHING

(75) Inventor: Yuusuke Torimaru, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 274 days.

(21) Appl. No.: 13/324,021

(22) Filed: Dec. 13, 2011

(65) Prior Publication Data

US 2012/0155902 A1 Jun. 21, 2012

(30) Foreign Application Priority Data

Dec. 16, 2010 (JP) ..... 2010-280197

(51) Int. Cl.
*G03G 15/00* (2006.01)

(52) U.S. Cl.
CPC ..... *G03G 15/657* (2013.01); *G03G 2215/0129* (2013.01); *G03G 15/6594* (2013.01)
USPC ..... 399/397; 399/400

(58) Field of Classification Search
CPC ... G03G 15/70; G03G 15/703; G03G 15/706; G03G 15/657; G03G 15/6532; G03G 2215/00548; G03G 2215/00552
USPC ..... 399/21, 22, 397, 398, 400
See application file for complete search history.

(56) References Cited

U.S. PATENT DOCUMENTS 5,086,318 A * 2/1992 Takeda et al.
5,537,193 A * 7/1996 Hasegawa et al. ..... 399/398
5,543,908 A * 8/1996 Suzuki ..... 399/398
5,666,621 A * 9/1997 Maekawa et al.
5,758,252 A * 5/1998 Enomoto et al.
5,822,665 A * 10/1998 Yamamoto et al.
5,893,657 A * 4/1999 Matsuzawa

FOREIGN PATENT DOCUMENTS

| | | | |
|---|---|---|---|
| JP | 5-119636 | A | 5/1993 |
| JP | 5-341664 | A | 12/1993 |
| JP | 9-15987 | A | 1/1997 |
| JP | 2000-242090 | A | 9/2000 |
| JP | 2000-267519 | A | 9/2000 |

* cited by examiner

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

An image forming apparatus includes an image bearing member; a stretched rotatable belt member; a transfer device for forming a transfer portion where a toner image is transferred from the image bearing member onto a recording material carried and conveyed on the belt member; a separation roller capable of separating the recording material from the belt member; a push-up device capable of pushing up a belt surface locally with respect to a widthwise direction of the belt member to separate the recording material from the belt member; and an execution portion for executing, when an abnormality occurs during an image forming operation, an operation in a stop mode in which the belt member is, after the image forming operation is stopped, rotated in a push-up state of the push-up device and then the rotation of the belt member is stopped.

7 Claims, 14 Drawing Sheets

(a)

(b)

(a)

(b)

(a)

(b)

(a)

(b)

(c)

IMAGE FORMING APPARATUS WITH BELT MEMBER PUSHING

FIELD OF THE INVENTION AND RELATED ART

The present invention relates to an image forming apparatus, in which a toner image is transferred from an image bearing member onto a recording material carried on a belt member. Specifically, the present invention relates to control for preventing an occurrence of secondary recording material jam at a periphery of the belt member during emergency stop due to an occurrence of recording material jam.

In an electrophotographic image forming apparatus in which the recording material is carried and conveyed by a transfer belt stretched by a plurality of rollers including a separation roller, the recording material on the transfer belt passes through a transfer portion and then is electrostatically attracted to the transfer belt.

However, when rigidity of the recording material is low, the recording material cannot be sufficiently separated from the transfer belt only by using curvature of a separation roller for stretching the transfer belt and by using the rigidity of the recording material. That is, the recording material is kept adhered to the transfer belt at a position of the separation roller, so that improper separation can occur. Therefore, a method in which a projection is evenly formed on the surface of the separation roller for stretching the transfer belt and at a separation position, waviness is provided on the transfer belt by the projection to separate the recording material has been proposed (Japanese Laid-Open Patent Application (JP-A) Hei 9-015987).

By the constitution in which the projection is constantly provided on the separation roller surface, the waviness can be formed on the transfer belt at the separation position but a large tension is always exerted locally on the transfer belt. As a result, due to an occurrence of local abrasion of the transfer belt, resistance non-uniformity when the transfer belt passes through the transfer portion occurs. In the case where the locally large tension acts on the transfer belt to cause deformation by the constant projection, there is a possibility of occurrences of contact non-uniformity and resistance non-uniformity when the transfer belt passes through the transfer portion. By the method relying on the constant projection, a transfer property of the toner image is not stabilized by the influence of the above factors and there is also a possibility of an occurrence of transfer non-uniformity.

Further, a method in which a cylindrical recording material carrying sheet for carrying the recording material is deformed for separating the recording material but a degree of abrasion due to the deformation is reduced has been described in JP-A Hei 5-119636. In JP-A Hei 5-119636, a constitution in which a roller is provided as a push-up means for a recording material carrying surface, inside the cylindrical recording material carrying-sheet is described. The roller as the push-up means is movable to a position where the transfer sheet is to be pushed up and a position where the transfer sheet is not to be pushed up. By pushing up the cylindrical recording material carrying sheet (transfer sheet) from the inside of the sheet, the recording material is separated from the recording material carrying sheet but during a period in which the recording material is not separated, the recording material carrying sheet is controlled so as not to be pushed up by the roller.

When the constitution described in JP-A Hei 5-119636 is applied to the transfer belt, the push-up means for locally pushing up the transfer belt during a separation step is disposed downstream of a transfer portion, where the toner image on the image bearing member is to be transferred onto the recording material on the transfer belt, with respect to a recording material conveyance direction.

In the case of the recording material, with the low rigidity, such as thin paper or the like, the recording material is conveyed in a state in which the transfer belt is locally pushed up by the push-up means. As a result, the waviness is provided on the recording material, so that flexibility (stiffness) of the recording material during a separation step can be temporarily increased (FIG. 6).

However, in the image forming apparatus using the belt member such as the transfer belt, when the recording material jam occurs during the image formation, an operation in a stop mode is executed in an interruption manner and thus rotation of the belt member is stopped. In this case, when the recording material adhered to the stopped belt member remains at the transfer portion or a position upstream of the transfer portion, in subsequently jam clearance, it is difficult to remove the recording material from the belt member.

For that reason, in order to move the recording material to a position spaced from the belt member, a constitution in which the belt member is rotated for a predetermined period after the jam occurrence may be employed. However, in the case of the thin paper, there is a possibility that the thin paper is wound about without being separated from the belt member.

SUMMARY OF THE INVENTION

A principal object of the present invention is to provide an image forming apparatus capable of avoiding winding up by separating a recording material from a belt member with reliability even in the case where jam occurs.

Accordingly, an aspect of the present invention is to provide an image forming apparatus comprising: an image bearing member; a stretched rotatable belt member; transfer means for forming a transfer portion where a toner image is transferred from the image bearing member onto a recording material carried and conveyed on the belt member; a separation roller, which stretches the belt member, capable of separating the recording material from the belt member; push-up means, provided upstream of the separation roller and downstream of the transfer portion with respect to a rotational direction of the belt member, capable of pushing up a belt surface locally with respect to a widthwise direction of the belt member to separate the recording material from the belt member; and an execution portion for executing, when abnormality occurs during an image forming operation, an operation in a stop mode in which the belt member is, after the image forming operation is stopped, rotated in a push-up state of the push-up means and then the rotation of the belt member is stopped.

These and other objects, features and advantages of the present invention will become more apparent upon a consideration of the following description of the preferred embodiments of the present invention taken in conjunction with the accompanying drawings.

Figure 2:
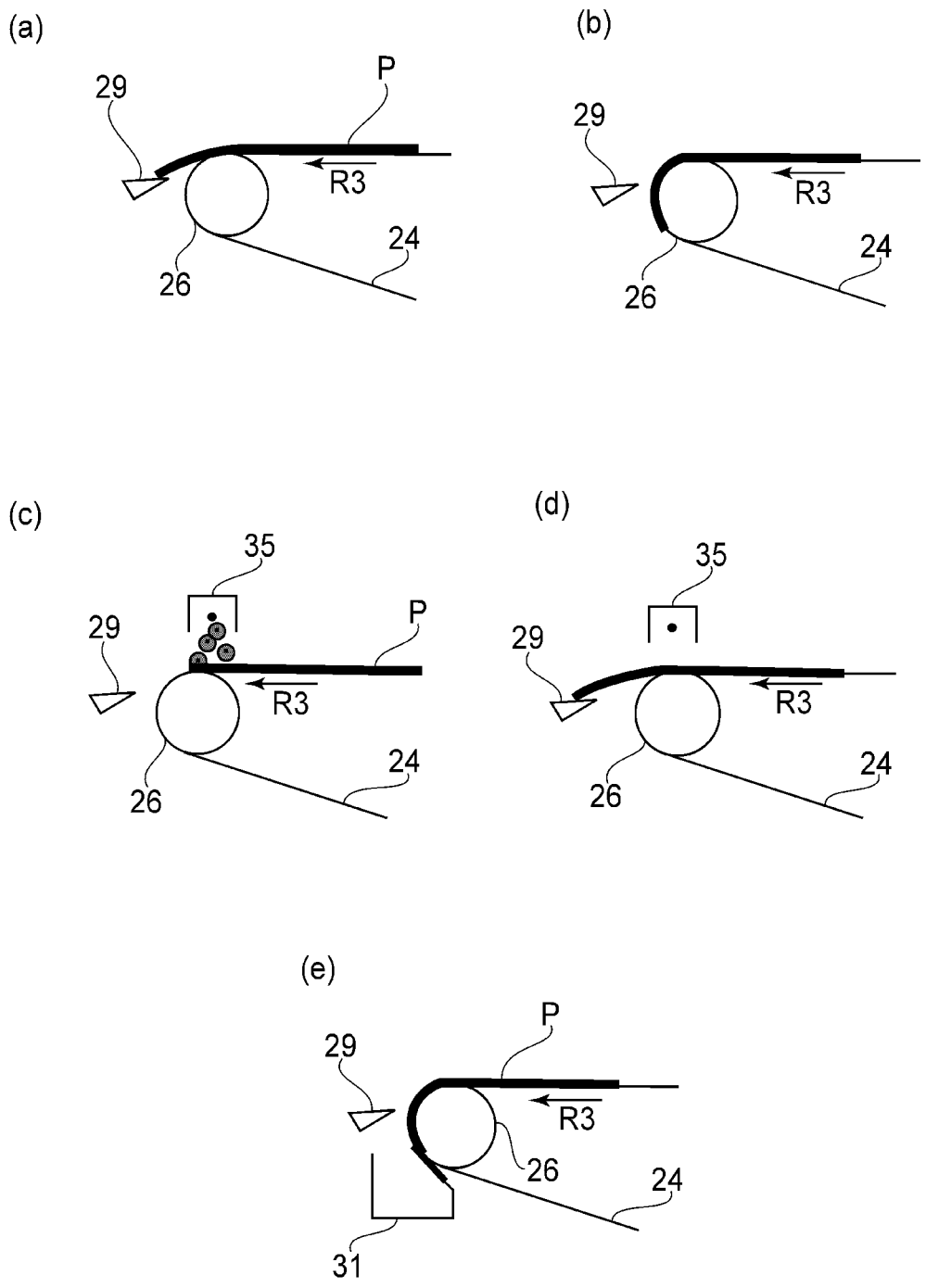

Parts (a) to (e) of FIG. 2 are schematic views for illustrating a recording material jam occurring at a separation portion of a transfer belt.

Figure 3:
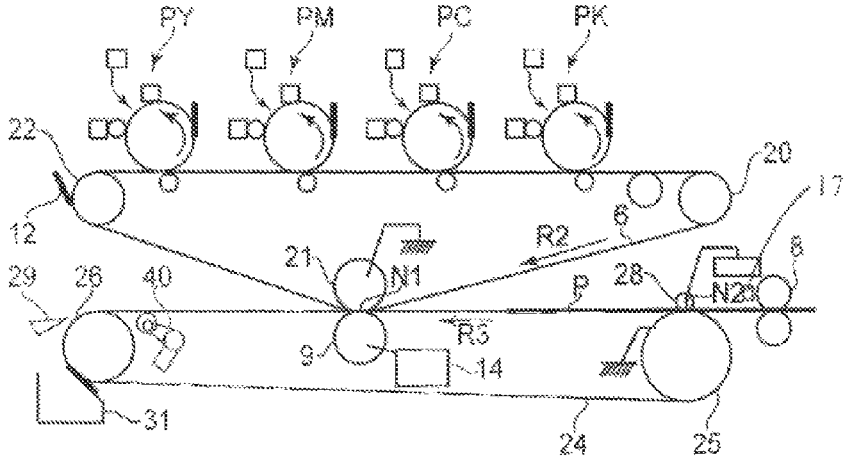
Figure 3:
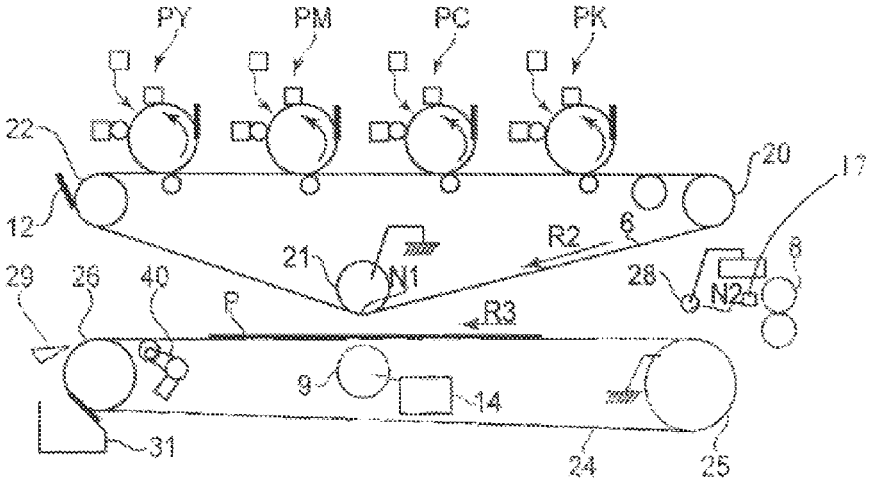

Parts (a) and (b) of FIG. 3 are illustrations of a secondary transfer portion releasing structure.

Figure 4:
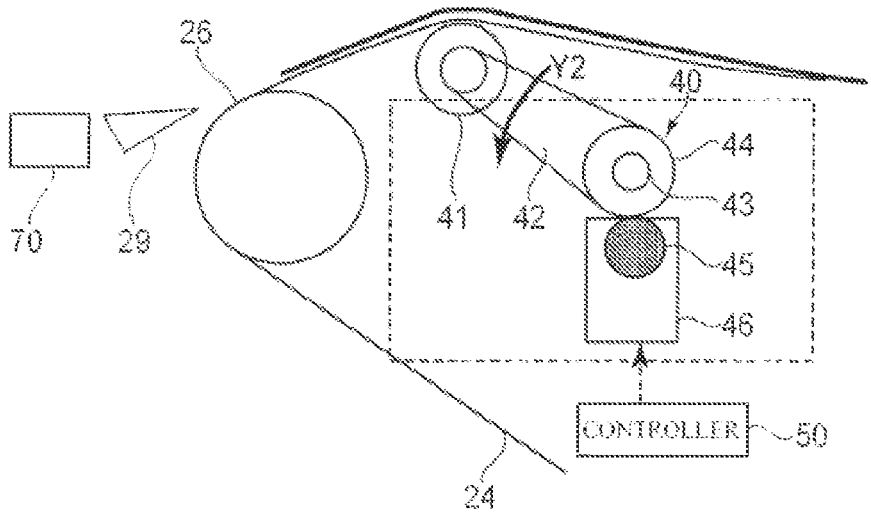
Figure 4:
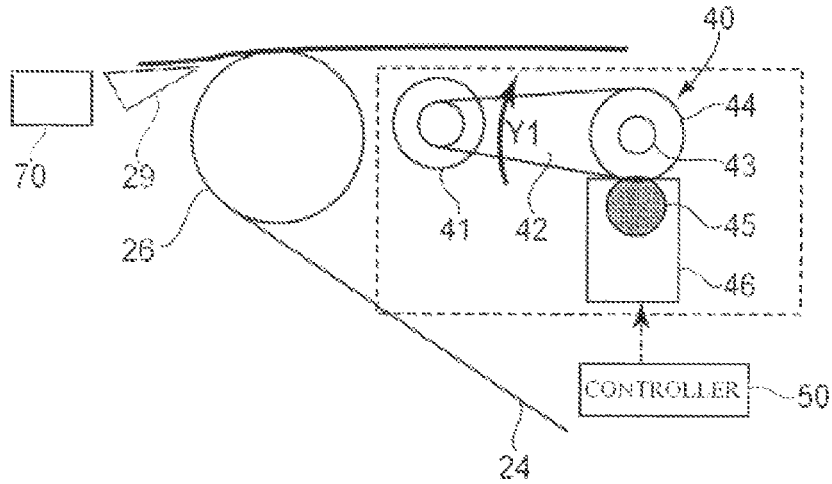

Parts (a) and (b) of FIG. 4 are illustrations of a structure and operation of an auxiliary separating device.

Figure 5:
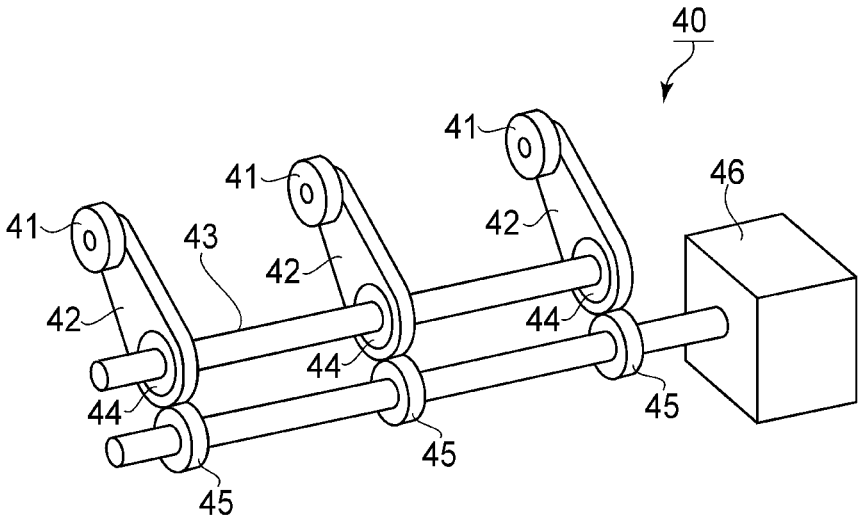
Figure 5:
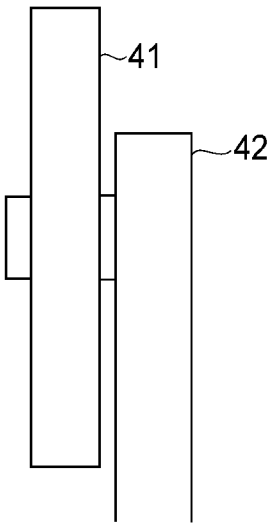

Parts (a) and (b) of FIG. 5 are a perspective view and a front view of a (free) end roller.

Figure 6:
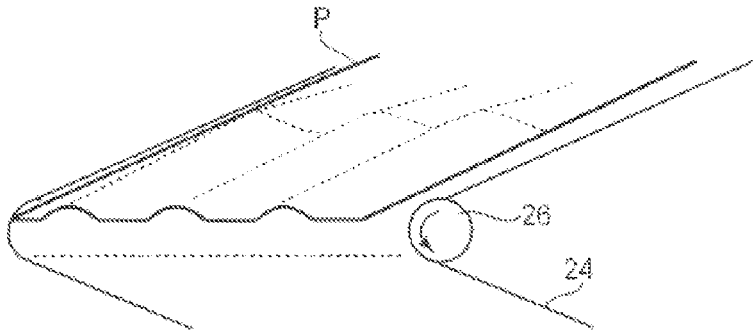

FIG. 6 is an illustration of separation of the recording material by the auxiliary separating device.

Figure 7:
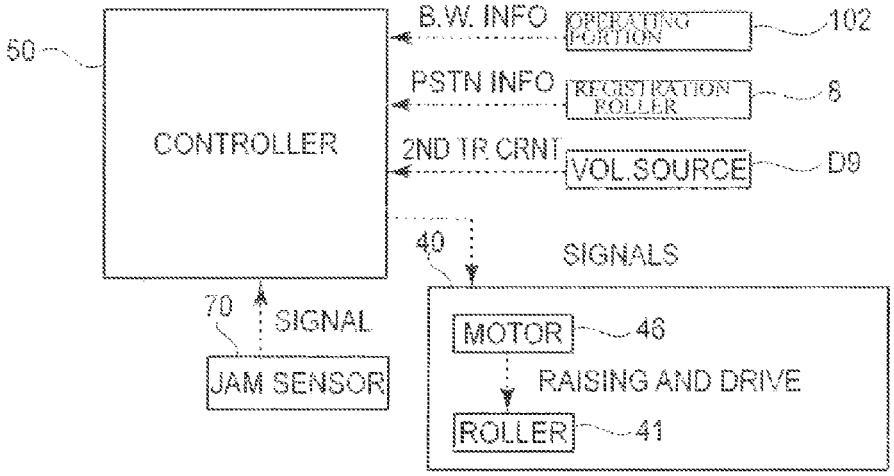

FIG. 7 is a block diagram of a control system of the auxiliary separating device.

Figure 8:
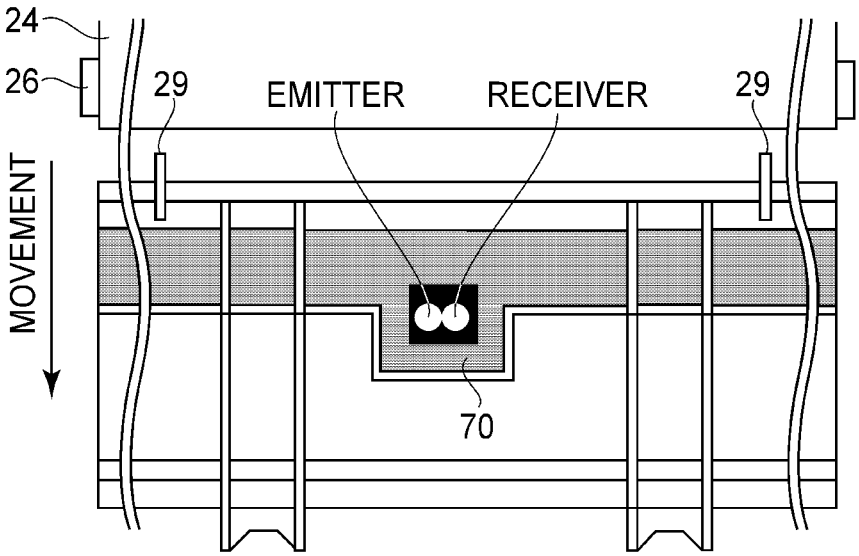

FIG. 8 is an illustration of a structure of a jam detecting sensor.

Figure 9:
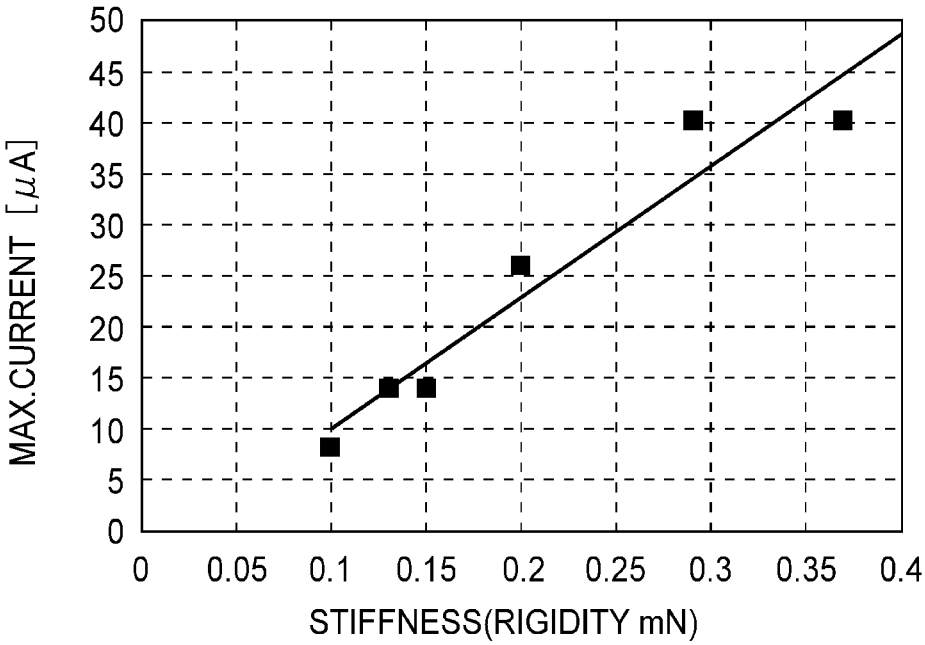

FIG. 9 is a graph showing a relationship between rigidity of the recording material and difficulty of separation of the recording material from the transfer belt.

Figure 10:
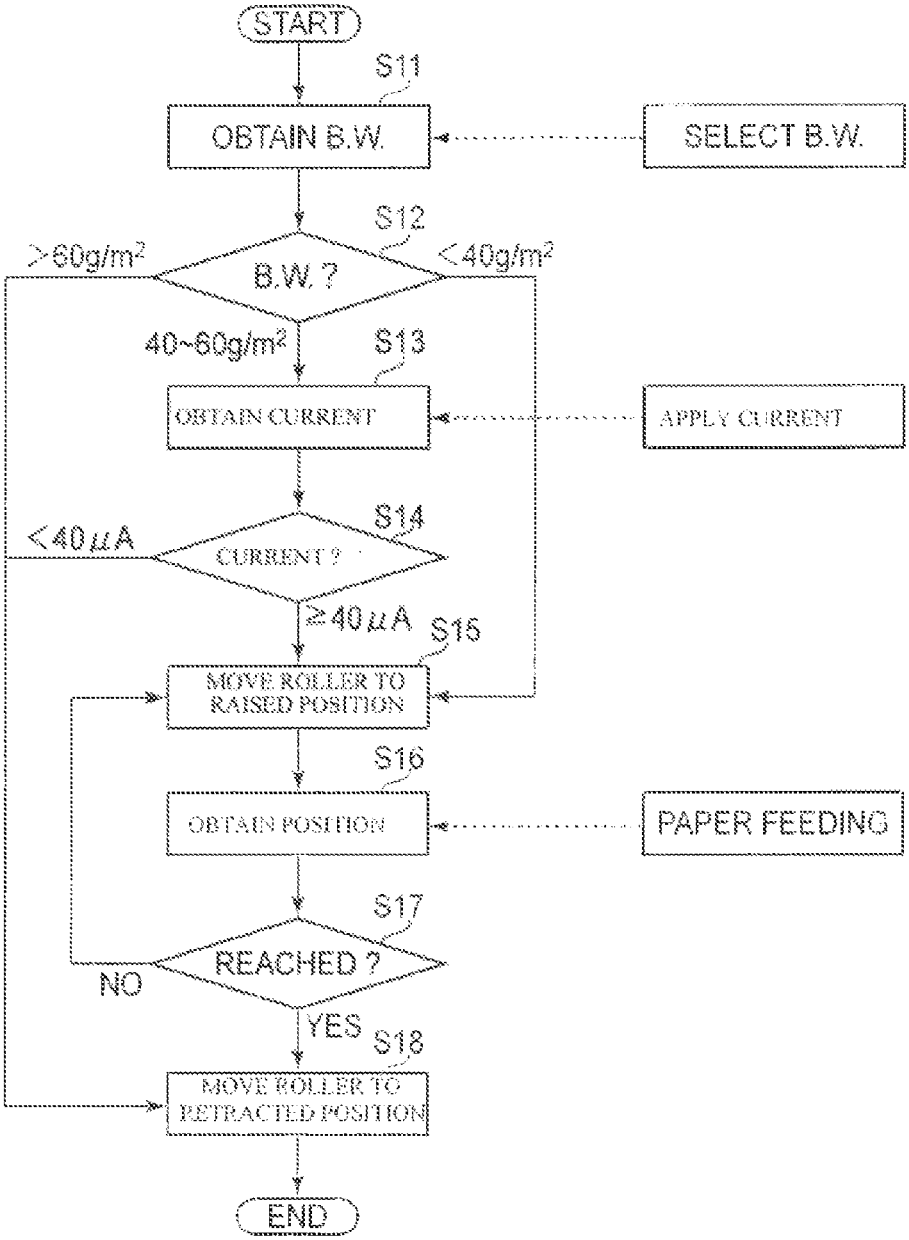

FIG. 10 is a flow chart of control of the auxiliary separating device during image formation.

Figure 11:
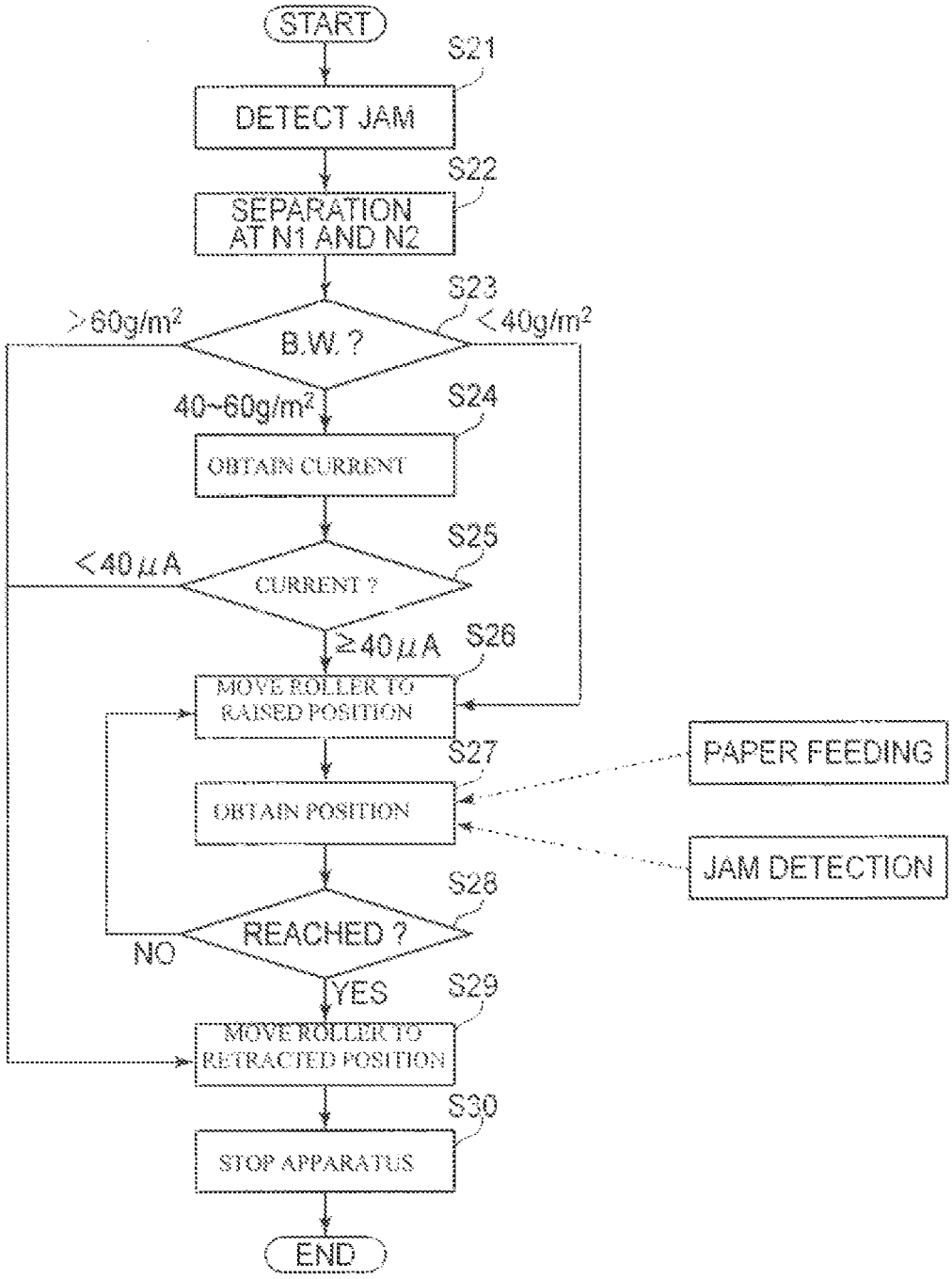

FIG. 11 is a flow chart of control of an operation in a stop mode in Embodiment 1.

Figure 12:
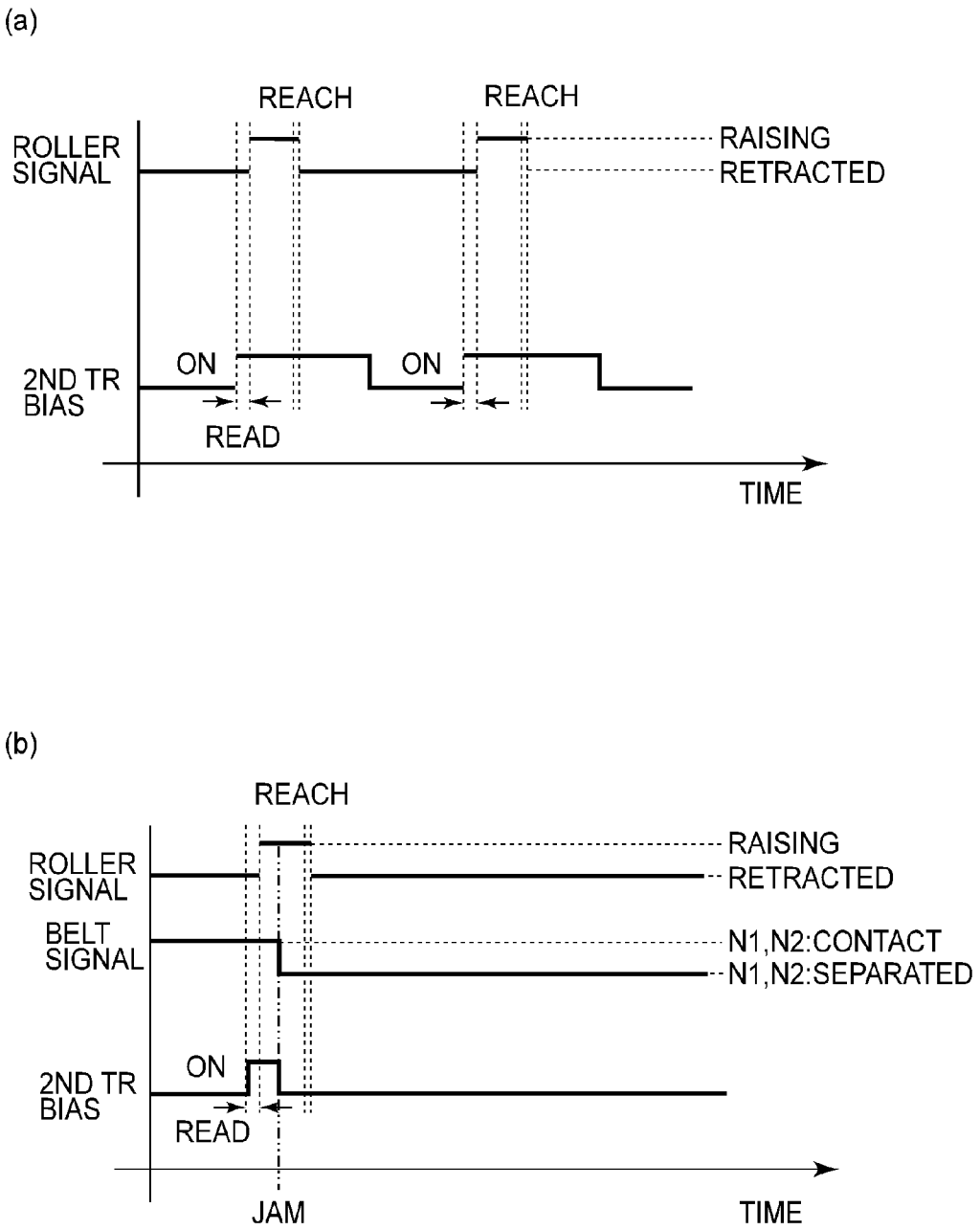

Parts (a) and (b) of FIG. 12 are illustrations of operation timing of the auxiliary separating device.

Figure 13:
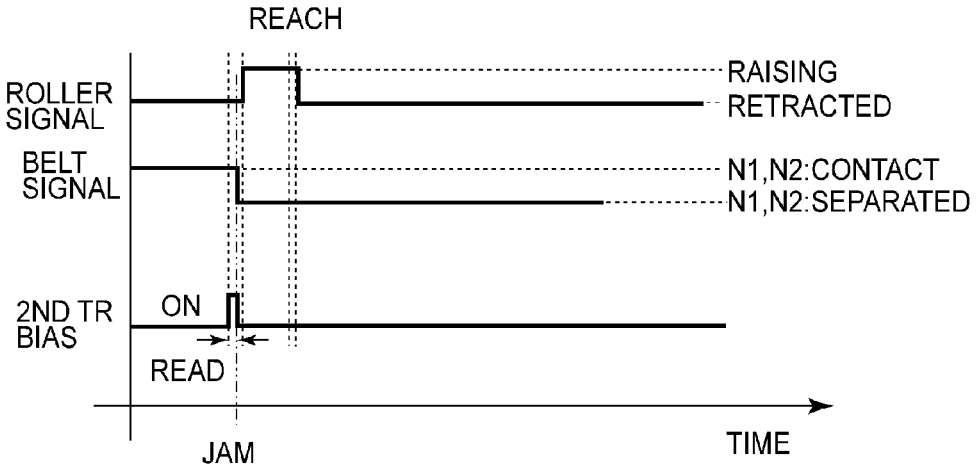

FIG. 13 is an illustration of operation timing of an auxiliary separating device in an operation in a stop mode in Embodiment 2.

Figure 14:
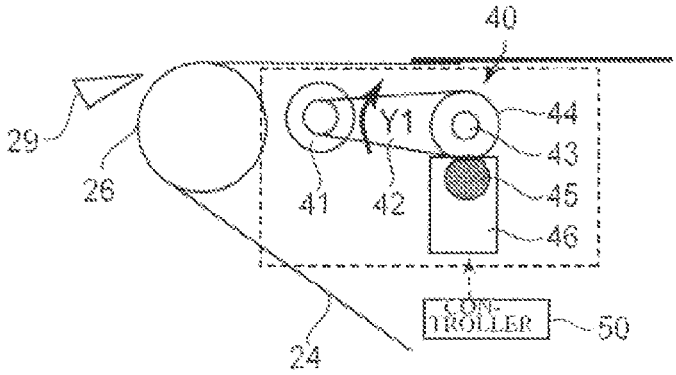
Figure 14:
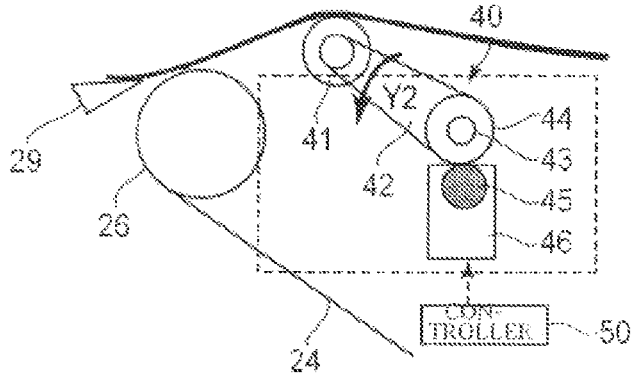
Figure 14:
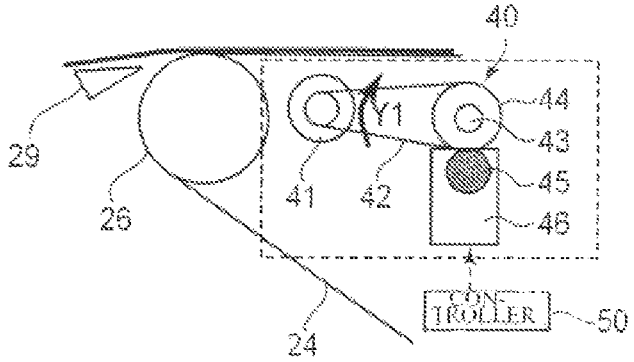

Parts (a) to (c) of FIG. 14 are illustrations of the operation of the auxiliary separating device in Embodiment 2.

Figure 15:
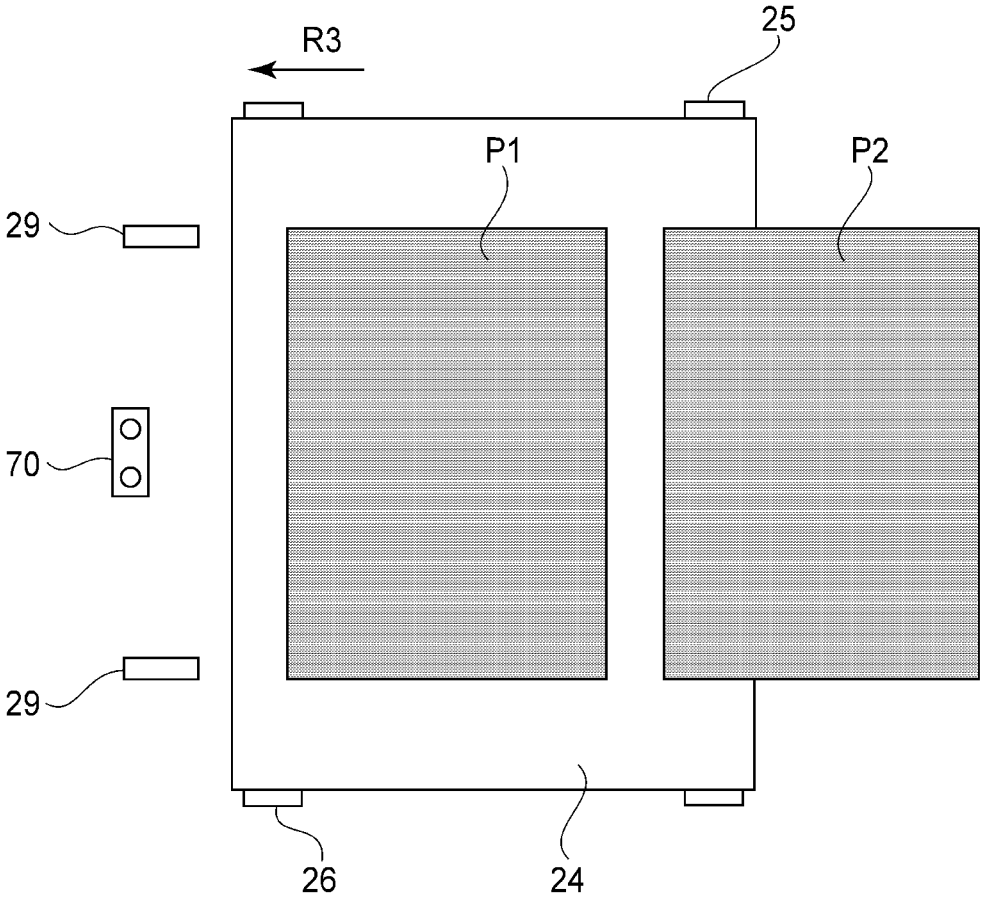

FIG. 15 is a top plan view of a conveyance state of the recording material by the transfer belt.

Figure 16:
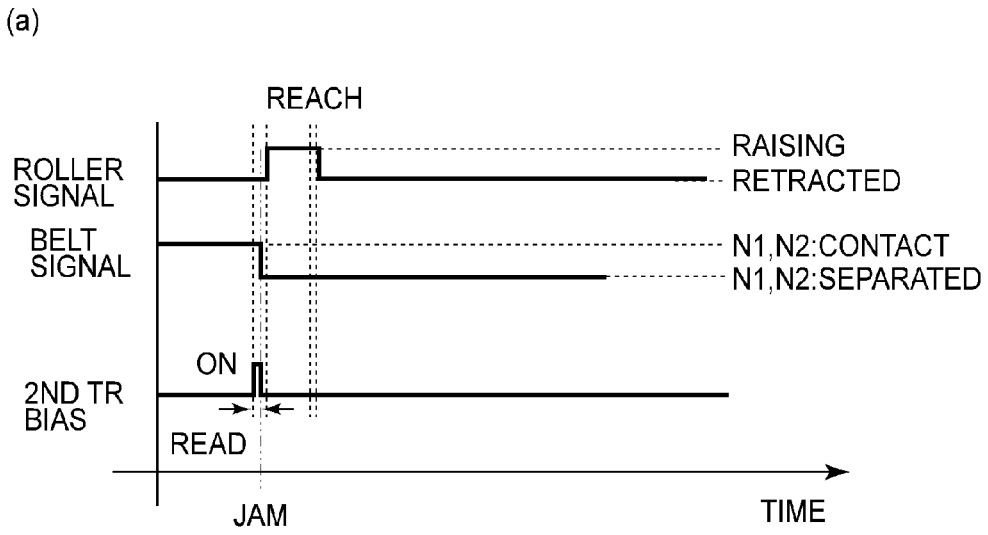
Figure 16:
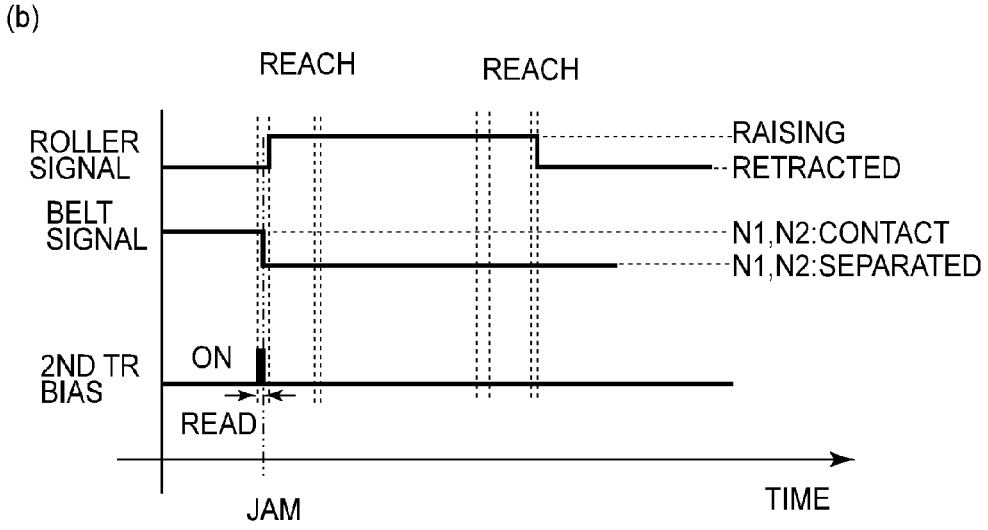

Parts (a) and (b) of FIG. 16 are illustration operation timing of an auxiliary separating device in an operation in a stop mode in Embodiment 3.

DESCRIPTION OF THE PREFERRED EMBODIMENTS

Hereinafter, embodiments of the present invention will be described in detail with reference to the drawings. The present invention can also be carried out in other embodiments in which a part or all of constitution of the following embodiments are replaced with alternative connections so long as a rib is formed on a recording material at a plurality of positions with respect to a transfer belt widthwise direction so that the rib is projects from the inside to the outside of the recording material during an occurrence of recording material jam.

Therefore, the present invention can be carried out irrespective of a constitution of an image forming portion so long as the image forming apparatus transfers a toner image onto the recording material carried on the transfer belt. The present invention can be carried out irrespective of types of monochromatic/full-color, one-component developer/two-component developer, tandem/one-drum, and intermediary transfer/direct transfer.

In the following embodiments, a principal portion relating to formation and transfer of a toner image will be described but the present invention can be carried out in image forming apparatus in various fields of a printer, various printing machines, a copying machine, a facsimile machine, a multifunction machine, and the like by adding necessary equipment, device and casing structure.

<Image Forming Apparatus>

Figure 1:
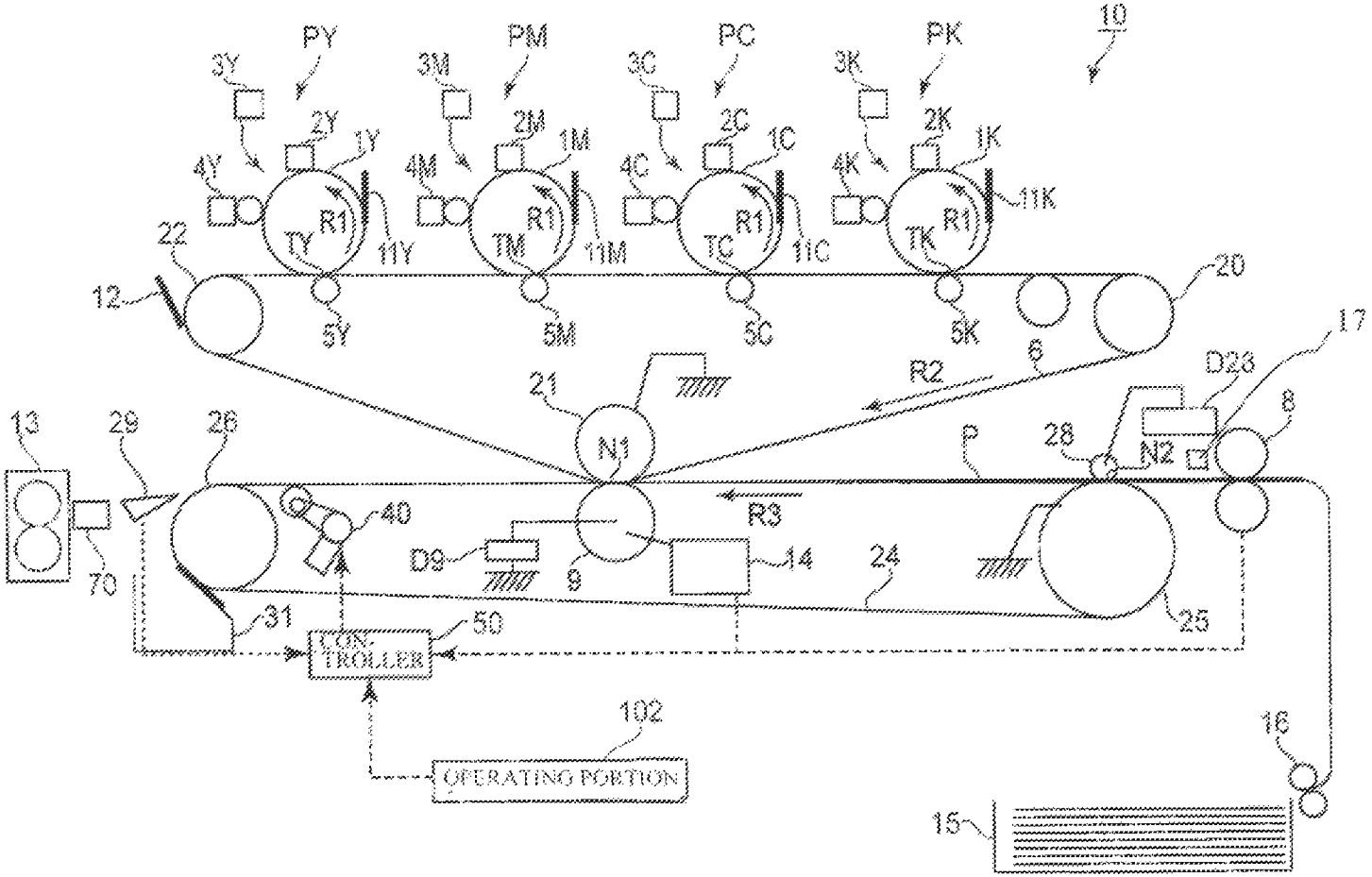
FIG. 1 is an illustration of a structure of an image forming apparatus.

FIG. 1 is an illustration of a structure constitution of the image forming apparatus. Parts (a) to (e) of FIG. 2 are schematic views for illustrating a recording material jam occurring at a separation portion of a transfer belt.

As shown in FIG. 1, an image forming apparatus 10 is a full-color printer of the tandem type and of the intermediary transfer type in which image forming portions PY, PM, PC and PK for yellow, magenta, cyan and black, respectively are sequentially arranged along an intermediary transfer belt 6.

In the image forming apparatus portion PY, a yellow toner image is formed on a photosensitive drum 1Y, and is primary-transferred onto the intermediary transfer belt 6. In the image forming portion PM, a magenta toner image is formed on a photosensitive drum 1M, and is primary-transferred onto the intermediary transfer belt 6. In the image forming portions PC and PK, cyan and black toner images are formed on photosensitive drums 1C and 1K, respectively, and are sequentially primary-transferred onto the intermediary transfer belt 6.

The recording material P is pulled out from a recording material cassette 15 and is separated one by one by a separation roller 16. A registration roller 8 once stops the recording material P and supplies the recording material P to a transfer belt 24 in synchronism with the toner images conveyed on the intermediary transfer belt 6 to a secondary transfer portion N1. The recording material P is electrically charged by an attraction roller 28 and intimately contacts the transfer belt 24, thus being conveyed to the secondary transfer portion N1 while being carried on the transfer belt 24.

Four color toner images transferred onto the intermediary transfer belt 6 are conveyed to the secondary transfer portion N1, in which the toner images are superposed on the recording material P on the intermediary transfer belt 6 and are nip-conveyed. During the nip-conveyance process, a voltage is applied to a secondary transfer roller 9, so that the toner images are secondary-transferred from the intermediary transfer belt 6 onto the recording material P. Transfer residual toner remaining on the intermediary transfer belt 6 without being transferred is collected by a belt cleaning device 12.

The recording material P on which unfixed toner images are transferred is separated from the transfer belt 24 at a position of a separation roller 26. Then, the recording material P on which the four color toner images are secondary-transferred are conveyed by the transfer belt 24 and the curvature-separated from the intermediary transfer belt 6 at a curved surface of the separation roller 26 and then are sent to a fixing device 13, in which the recording material P is subjected to heat and pressure, so that the toner images are fixed on the recording material P and then the recording material P is discharged out of the apparatus 10.

The image forming portions PY, PM, PC and PK are substantially the same in structure except that colors of the toners used in developing devices 4Y, 4M, 4C and 4K are yellow, magenta, cyan and black, i.e., different from each other. Thus, the yellow image forming portion PY will be described below. As for the description of the other image forming portions PM, PC and PK, the suffix Y of constituent members of the image forming portion PY shall be replaced with M, C and K, respectively.

The image forming portion PY includes, at a periphery of a photosensitive drum 1Y, a corona charging device 2Y, an exposure device 3Y, the developing device 4Y, a primary transfer roller 5Y, and the drum cleaning device 11Y. The photosensitive drum 1Y is rotated at a process speed of 250-300 mm/sec in the direction indicated by an arrow R1. The corona charging device 2Y uniformly changes the surface of the photosensitive drum 1Y. The exposure device 3Y scans the surface of the photosensitive drum 1Y with a laser beam, obtained by subjecting scanning line image data expanded from a yellow separated color image to ON-OFF modulation, so that an electrostatic image for an image is written (formed) on the photosensitive drum 1Y. The developing device 4Y uses a two component developer containing a toner and a carrier to reversely develop the electrostatic image, so that the toner image is formed on the photosensitive drum 1Y.

The primary transfer roller 5Y contacts the inner surface of the intermediary transfer belt 6 to form a primary transfer portion TY between the photosensitive drum 1Y and the intermediary transfer belt 6. A voltage is applied to the primary transfer roller 5Y, so that the toner image carried on the photosensitive drum 1Y is primary-transferred onto the intermediary transfer belt 6. The drum cleaning device 11Y rubs the photosensitive drum 1Y with the cleaning blade to collect the transfer residual toner.

Incidentally, in recent years, with increasing use of the image forming apparatus, the image forming apparatus is required to meet the recording material with low rigidity (stiffness), such as thin paper. However, the recording material with low rigidity is liable to be curled at its leading end and the leading end is deformed by sliding with a guide and thus is liable to lag, so that the toner images cannot be stably transferred. Therefore, in the image forming apparatus 10, the recording material is electrostatically attracted to the transfer belt 24 and is passed through the transfer portion N1.

However, the image forming apparatus 10 is intended to meet the recording material with an extremely low rigidity of 40 g/m$^2$ in basis weight. When the rigidity of the recording material is extremely low, it is difficult to separate the recording material from the transfer belt 24 only by a separation claw 29.

As shown in (a) of FIG. 2, in the case where the rigidity of the recording material P is high, when the recording material P attracted to the transfer belt 24 comes near to the separation roller 26, its leading end is curvature-separated and therefore the separation can be assisted by catching the leading end by the separation claw 29.

As shown in (b) of FIG. 2, in the case where the rigidity of the recording material P is low, the leading end of the recording material P is not curvature-separated even when the recording material P comes near to the separation roller 26, so that the recording material is still attracted to the transfer belt 24 and thus separation cannot be assisted by the separation claw 29. This phenomenon is conspicuous in a low temperature and low humidity environment in which the recording material P is dry and has a small water content and therefore a resistance of the recording material P is large and thus n electrical attraction force between the recording material P and the transfer belt 24 is increased.

As shown in (c) of FIG. 2, as a separation assisting method, there is a method in which electric charges are removed from the recording material attracted to the transfer belt 24 to reduce the electrical attraction force. A corona discharger 35 is provided so as to force the surface of the recording material P on which the toner images are transferred. By reducing the electrical attraction force between the transfer belt 24 and the recording material P, even with respect to the recording material P with the low rigidity, the leading end of the recording material P can be separated at a curvature portion of the separation roller 26. Further, in this state, an effect of the separation claw 29 can also be expected and therefore the separation claw 29 is combined with the corona discharger 35 as shown in (d) of FIG. 2, so that it becomes possible to perform the separation of the recording material P from the transfer belt 24 with reliability.

However, ozone generated by the corona discharger adversely affects a rubber material for the transfer belt 24 to decrease a lifetime of the transfer belt 24. Further, the corona discharger 35 and its power source disturb production cost reduction and downsizing of the image forming apparatus. The method in which the electric charges of the transfer belt 24 are removed by relying on the corona discharger 35 has a low effect in a low humidity environment in which the resistance of the recording material is high and the electric charges are not readily removed, thus being liable to cause improper separation.

For that reason, in the image forming apparatus 10 including the transfer belt 24 for performing the transfer and conveyance of the recording material P, there is a need to stably perform the conveyance of the low rigidity recording material P by the transfer belt 24 and the separation of the low rigidity recording material P from the transfer belt 24 without relying on the corona discharger. As a technique for assisting the separation from the transfer belt 24, when such a technique that the waviness is provided to the recording material P with respect to a direction perpendicular to the conveyance direction of the recording material P is not employed, it is difficult to separate the recording material P with the basis weight of 40 g/m$^2$ or less.

<Intermediary Transfer Belt>

Parts (a) and (b) of FIG. 3 are illustrations of a secondary transfer portion releasing structure. As shown in FIG. 1, the intermediary transfer belt 6 is stretched around a tension roller 22, a belt driving roller 20 and a secondary transfer opposite roller 21 and is rotated at the above-described process speed in a direction indicated by an arrow R2.

The intermediary transfer belt 6 is adjusted to have a volume resistivity of $1\times10^9$-$1\times10^{14}$ (Ω·cm) by incorporating carbon black in an appropriate amount into various resin or rubber materials such as polyimide and polycarbonate. The thickness of the intermediary transfer belt 6 is 0.07-0.1 (mm).

The secondary transfer roller 9 is a sponge roller which is prepared by forming an elastic layer of ion-conductive foam rubber (NBR rubber) around a core metal of stainless steel and is 24 mm in outer diameter and $1\times10^6$-$1\times10^7$Ω in resistance. A roller surface roughness is Rz=6.0-12.0 (μm). The resistance was measured by applying the voltage of 2 kV in a normal temperature/normal humidity (N/N) environment of 23° C. and 50% RH. To the secondary transfer roller 9, a transfer power source D9 with variable output is connected.

The transfer portion N1 is formed between the intermediary transfer belt 6 supported by the secondary transfer opposite roller 9 at the inner surface and the transfer belt 24 supported by the secondary transfer roller 9 at the inner surface. The transfer belt 24 moves in an arrow R3 direction, so that the recording material P on the transfer belt 24 passes through the secondary transfer portion N1. The recording material P guided into the secondary transfer portion N1 is nip-conveyed through the secondary transfer portion N1 and during the nip-conveyance, a constant voltage (transfer bias) which is controlled at a predetermined value and has a polarity opposite to a charge polarity of the toner is applied from the transfer power source D9. The transfer power source D9 applies a secondary transfer current of +30 to +60 μA to the secondary transfer roller 9, so that the four color toner images superposed on the intermediary transfer belt 6 are transferred onto the recording material P. A necessary secondary transfer current varies depending on factors such as a drying state of the recording material P, the environment, an amount of the toner to be transferred, and the like.

As shown in (b) of FIG. 3, the secondary transfer roller 9 is lowered by a lifting device 14, thus being separable from the inner surface of the transfer belt 24. The transfer belt 24 actually contacts the intermediary transfer belt 6 in a state in which it is upwardly pushed up by the secondary transfer roller 9 and therefore when the secondary transfer roller 9 is lowered, the transfer belt 24 is separated from the intermediary transfer belt 6 to release the secondary transfer portion N1. During image formation, in a period in which the toner images are secondary-transferred from the intermediary transfer belt 6 onto the recording material P, the secondary transfer roller 9 is raised to form the secondary transfer portion N1 as shown in (a) of FIG. 3. However, with timing other than that timing, as shown in (b) of FIG. 3, the secondary transfer roller 9 is lowered to release the secondary transfer portion N1.

The recording material P passing through the secondary transfer portion N1 is conveyed to the separation roller 26 and is separated from the transfer belt 24 by the separation claw 29. The intermediary transfer belt 6 after the secondary transfer is subjected to cleaning by the belt cleaning device 12 to remove the transfer residual toner, paper dust or the like. The transfer belt 24 after the separation of the recording material P is subjected to cleaning by a transfer belt cleaning device 31 to remove the transfer residual toner, paper dust or the like.

<Transfer Belt>

The transfer belt 24 is stretched around an entrance roller 25 also functioning as the tension roller, the separation roller 26 also functioning as the driving roller, and the secondary transfer opposite roller 21 and is rotated at the above-described process speed in an arrow R3 direction. The entrance roller 25 is supported by unshown spring members at its ends and generates a predetermined tension applied to the belt member.

The separation roller 26 forms a curved surface (separation portion) on the transfer belt 24 to separate the recording material P from the curved surface. The separation roller 26 is a roller which is formed of stainless steel and is 16 mm in outer diameter.

As the transfer belt 24, an elastic member of 10 MPa or less in Young's modulus measured in accordance with a tensile testing (JIS K 6301) is used. The transfer belt 24 can be rotationally driven while sufficiently retaining its belt shape by using a material of 0.5 MPa or more in Young's modulus. The transfer belt 24 can effectively generate the waviness on the recording material P by an auxiliary separating device 40 described later by using a member which is 10 MPa or less in Young's modulus and is capable of being sufficiently deformed elastically. As a result, it becomes possible to achieve the effective separation of the recording material P from the transfer belt 24. When the transfer belt 24 can be sufficiently deformed elastically, as shown in (a) of FIG. 3, a relaxation phenomenon of the transfer belt 24 when the (free) end roller 41 is retracted occurs easily and therefore it becomes possible to prevent the decrease of the lifetime of the transfer belt 24 due to the auxiliary separating device 40.

In order to detect a toner image, formed at an interval between the toner images for an image, for detecting the toner content (concentration) or a toner position information, the transfer belt cleaning device 31 is provided at a position where it contacts the transfer belt 24 contacting the separation roller 26. By the contact of the transfer belt cleaning device 31 with the transfer belt 24 contacting the separation roller 26, there is no need to provide an unnecessary space for cleaning. The transfer belt cleaning device 31 is a cleaning device of a counter blade type.

<Attraction Portion>

As shown in FIG. 1, the recording material P conveyed by the registration roller 8 is attracted to the transfer belt 24 by being nip-conveyed between the transfer belt 24 supported by the entrance roller 25 at the inner surface and the attraction roller 28 supplied with a DC voltage. An attraction portion N2 is formed between the attraction roller 28 and the transfer belt 24 supported by the entrance roller 25 connected to the ground potential. An attraction power source D28 applies an attraction voltage, which is subjected to constant-current control at −15 to −30 μA, to the attraction roller 28 in a process in which the recording material P is nip-conveyed through the attraction portion N2.

The entrance roller 25 is a rubber roller which is prepared by forming an elastic layer of an ion-conductive solid rubber (NBR rubber) around a core metal of stainless steel and is 18 mm in outer diameter and $1\times10^5$-$1\times10^6\Omega$ in resistance. The resistance was measured under application of the voltage of 50 V in the N/N environment of 23° C. and 50% RH.

The attraction roller 28 is a fur brush roller which is prepared by providing electroconductive nylon fibers of 5 mm in length around core metal of 8 mm in diameter and is 18 mm in outer diameter and $1\times10^5$-$1\times10^6\Omega$ in resistance. The resistance was measured under application of the voltage of 100 V in the N/N environment of 23° C. and 50% RH.

<Auxiliary Separating Device>

Parts (a) and (b) of FIG. 4 are illustrations of a structure and operation of the auxiliary separating device. Parts (a) and (b) of FIG. 5 are a perspective view and a front view of a (free) end roller. FIG. 6 is an illustration of separation of the recording material by the auxiliary separating device.

As shown in FIG. 1, the transfer belt 24 which is an example of the stretched rotatable belt member carries and conveys the recording material P and sends the recording material P to the secondary transfer portion N1 which is an example of the transfer portion. The separation roller 26 stretches an end portion of the transfer belt 24, so that the recording material P carried on the transfer belt 24 is separable from the transfer belt 24. The separation claw 29 which is an example of a guide member guides the leading end of the recording material P separated from the transfer belt 24, thus being capable of retaining a separation state.

The secondary transfer roller 9 which is an example of the transfer means transfers the toner images, formed on the intermediary transfer belt 6 which is an example of an image carrying member, onto the recording material P carried on the transfer belt 24. At the secondary transfer portion N1, nip pressure applied to the recording material P is releasable.

The attraction roller 28 which is an example of the charging means is disposed contactable to and separable from the outer surface of the transfer belt member. The attraction roller 28 sandwiches the recording material P, to be fed to the secondary transfer portion N1 during the image formation, between itself and the transfer belt 24, so that the recording material P is electrically attracted to the transfer belt 24.

The auxiliary separating device 40 which is an example of the push-up means separates the recording material P, from the transfer belt 24, carried on the transfer belt 24. The auxiliary separating device 40 is capable of locally pushing up, by the end roller 41, a belt surface located upstream of the separation roller 26 and downstream of the secondary transfer portion N1 with respect to the rotational direction so that a pushed up portion extends in a widthwise direction of the transfer belt 24.

The end roller 41 which is an example of a pushing member is contactable to and separable from the inner surface of the transfer belt 24 and is capable of forming, on the transfer belt 24, undulation or waviness for facilitating the separation of the recording material.

As an assisting device for separating the recording material P from the transfer belt 24, the separation claw 29 is disposed downstream of the separation roller 26 and the auxiliary separating device 40 is provided at the inner surface, of the transfer belt 24, located upstream of the separation roller 26.

As shown in (a) of FIG. 4, the auxiliary separating device 40 is constituted by the end roller 41, a roller frame 42, a roller swing center shaft 43, a roller driving gear 44, a motor drive transmission gear 45 and a motor 46.

Rotational motion of the motor 46 is transmitted to the roller driving gear 44 by the motor drive transmission gear 45. Here, a bearing is provided between the roller driving gear 44 and the roller swing center shaft 43 and therefore the roller swing center shaft 43 is not influenced by the rotational drive by the motor, so that the position of the roller swing center shaft 43 is not moved.

The end roller 41 is rotatably shaft-supported by the roller frame 42. The end roller 41 is formed with ethylenepropylene rubber (EPDM) and is 6-10 mm in outer diameter and about 5-15 mm in longitudinal width.

When the inner surface of the transfer belt 24 is pushed up by the end roller 41, the roller frame 42 is rotationally moved about the roller swing center shaft 43 in Y1 direction from a roller-retracted (accommodated) position, thus being swung and moved to a roller-raised position as shown in (a) of FIG. 4. On the other hand, when the raised state of the transfer belt 24 by the end roller 41 is released, the roller frame 42 is rotationally moved from the roller-raised position shown in (a) of FIG. 4 in Y2 direction, thus being swung and moved to the roller-retracted position shown in (b) of FIG. 4.

As shown in (b) of FIG. 4, at the roller-retracted position, a spacing of about 4 mm to about 8 mm is ensured between the end roller 41 and the separation roller 26. As shown in (a) of FIG. 4, at the roller-raised position, the end roller 41 raises the transfer belt 24 from a horizontal state by about 10 mm to about 20 mm, so that an upstreammost contact point between the transfer belt 24 and the separation roller 26 is changed.

As shown in (a) and (b) of FIG. 5, a plurality of end rollers 41 are disposed at an interval of about 50 mm to about 120 mm between adjacent rollers with respect to the longitudinal direction of the roller swing center shaft 43 (the widthwise direction of the transfer belt 24). By disposing the plurality of end rollers 41 with respect to the longitudinal direction of the roller swing center shaft 43, the rigidity (stiffness) of the recording material with respect to the recording material conveyance direction obtained by the auxiliary separating device 40 is increased. For this reason, it becomes possible to accomplish stable separation of the recording material from the transfer belt 24.

The waviness generated with respect to the widthwise direction of the transfer belt 24 by the plurality of end rollers 41 reaches the contact point between the separation roller 26 and the transfer belt 24, so that the stiffness provided to the recording material P at the separation portion is increased and therefore further stable separation of the recording material P from the transfer belt 24 can be achieved.

At the roller-raised position shown in (a) of FIG. 4, all the plurality of end rollers 41 arranged to the longitudinal direction of the separation roller 26 raise the transfer belt 24 to wave the transfer belt 24 with respect to the widthwise direction. In this case, a state in which the recording material P reaches the position of the separation roller 26 is shown in FIG. 6. On the recording material P electrostatically attracted to and along the transfer belt 24 by the auxiliary separating device 40, the waviness is generated as shown in FIG. 6, so that the rigidity (stiffness) of the recording material P against bending stress with respect to the recording material conveyance direction is increased.

<Controller>

FIG. 7 is a block diagram of a control system of the auxiliary separating device. FIG. 8 is an illustration of a structure of a jam detecting sensor. FIG. 9 is a graph showing a relationship between rigidity of the recording material and difficulty of separation of the recording material from the transfer belt.

As shown in FIG. 7, an operation position of the auxiliary separating device 40 and a contact and separation operation between the intermediary transfer belt 6 and the transfer belt 24 are controlled by a controller 50. When a user designates the recording material P by operating a user operating portion 102, the controller 50 reads basis weight information of the designated recording material P from a memory. The controller obtains a recording material leading end position information by a recording material passing sensor 17 provided in front of the registration roller 8 and then rewrites the recording material leading end position information depending on recording material feeding timing of the registration roller 8.

As shown in FIG. 8, the recording material which is separated from the transfer belt 24 rotating around the separation roller 26 and reaches the separation claw 29 detected by a jam detecting sensor 70. The controller 50 stops the operation of the auxiliary separating device 40 with timing when the jam detecting sensor 70 detects the recording material, thus releasing the undulation of the transfer belt 24.

Incidentally, the jam detecting sensor 70 is of an optical type in which a light emitting portion and a light receiving portion for infrared light are provided and the presence or absence of reflected light is detected. However, a jam detecting sensor of a contact type in which a flag is controlled to the leading end of the recording material P to detect the recording material passing timing may also be used.

The controller 50 sends, on the basis of a secondary transfer current value read by the transfer power source D9, an operation position signal to the auxiliary separating device 40 and a contact and separation signal to the transfer belt 24, thus controlling the auxiliary separating device 40 and the transfer belt 24. On the basis of Table 1, the controller 50 controls switching of the operation position of the auxiliary separating device 40 and the contact and separation operation of the transfer belt 24.

TABLE 1

| | Basis weight ($g/m^2$) of RM*2 | | |
|---|---|---|---|
| STC*1 | <40 | 40-60 | >60 |
| ≥40 | Raised | Raised | Not raised |
| <40 | Raised | Not raised | Not raised |

*1"STC" represents a secondary transfer current.
*2"RM" represents the recording material P.

A basis of a criterion in Table 1 is a result of study shown in FIG. 9 in which a value of the secondary transfer current, with respect to the stiffness of the recording material, at which the recording material is separable from the transfer belt 24 is obtained. The stiffness as the abscissa of FIG. 9 is represented by a numerical value of Gurley stiffness measured, in accordance with a method defined by JIS L 1096, by using a Gurley stiffness measuring device ("Auto Scan" mfd. by Kumagai Riki Kogyo Co., Ltd.).

As shown in FIG. 9, with a smaller value of the recording material rigidity (stiffness), the secondary transfer current at which the recording material is separable from the transfer belt 24 is decreased. For example, in the case where the current of 40 μA is passed in order to transfer the toner image onto the recording material, when the stiffness of the recording material P is not 0.35 mN or more as the value measured by the Gurley stiffness measuring device, the separation is severe and therefore there is a need to increase the stiffness of the recording material.

The recording material stiffness of 0.35 mN measured by the Gurley stiffness measuring device is the numerical value which can be provided when the basis weight used for controlling the thickness of the recording material by a general user is 60 g/m$^2$ or more. For this reason, as shown in Table 1, in the case where the secondary transfer current of 40 μA or more and the basis weight of the recording material is 60 g/m$^2$ or less, the separation from the transfer belt is severe and therefore the auxiliary separating device 40 is actuated ("Raised").

Further, when the basis weight of the recording material is 40 g/m$^2$ or less, the stiffness measured by the Gurley stiffness measuring device is a very small value of, e.g., 0.1 mN or less. At such a value, the secondary transfer current at which the recording material is separable from the transfer belt 24 is 10 μA or less at which improper transfer occurs. Therefore, when the basis weight of the recording material is 40 g/m$^2$ or less, in order to increase the recording material stiffness, the auxiliary separating device is always actuated ("Raised").

<Control During Image Formation>

FIG. 10 is a flow chart of control of the auxiliary separating device during image formation. As shown in FIG. 1, in a normal operation in the image forming apparatus 10, the image forming apparatus 10 is in a state in which the image forming apparatus 10 is capable of forming the image in a continuous or intermittent manner. During the normal operation (transfer), as shown in (A) of FIG. 3, the contact state is created at the secondary transfer portion N1 and the attraction portion N2.

During the normal operation, under the transfer condition of "Raised (roller raising operation is performed)" shown in Table 1, until the jam detecting sensor 70 shown in FIG. 8 detects the recording material leading end (until the recording material leading end is held by the separation claw 29), at the position of the projections, the waviness is generated on the transfer belt. As a result, the waviness is also generated on the recording material to enhance the rigidity (stiffness) of the recording material, so that a separation property of the recording material from the transfer belt is enhanced. In the case where the recording material leading end is detected by the jam detecting sensor 70 and the separation of the recording material from the transfer belt 24 is ensured with reliability even when there is no waviness on the recording material, the position of the end roller 41 is spaced from the inner surface of the transfer belt 24.

However, the reason for the spacing is not "for preventing deformation of the transfer belt 24 during stop" in a stop mode described later but is "for preventing electrical and mechanical influences on the toner image transferred on the recording material".

As shown in FIG. 10 with reference to FIG. 7, the controller 50 reads basis weight information of the recording material P designated by the user at the user operating portion 102 (S11). Then, the basis weight of the recording material P designated by the user exceeds 60 g/m$^2$ (>60 g/m$^2$ of S12), the auxiliary separating device 40 is kept at an accommodated position and the raising operation of the transfer belt 24 is not performed (S18). However, in the case where the basis weight of the recording material P is less than 40 g/m$^2$ (<40 g/m$^2$ of S12), the auxiliary separating device 40 is moved in the Y1 direction to place the transfer belt 24 in the raised state (S15).

In the case where the basis weight of the recording material P is 40 g/m$^2$ or more and 60 g/m$^2$ or less (40-60 g/m$^2$ of S12), the controller 50 reads the secondary transfer current value (S13) and then judges the operation of the auxiliary separating device 40. The controller 50 applies a constant voltage, for measuring the secondary transfer current, to the secondary transfer portion N1 immediately before the recording material P reaches the secondary transfer portion N1 and then reads the secondary transfer current at the recording material leading end.

The controller 50 rotates, when the secondary transfer current is 40 μA or more (≥40 μA of S14), the auxiliary separating device 40 in the Y1 direction to place the transfer belt 24 in the raised state (S15). However, when the secondary transfer current is less than 40 μA (<40 μA of S14), the auxiliary separating device 40 is kept at the retracted position as it is (S18).

Further, in a state in which there is no recording material to be separated due to an interval between the toner images for the image, there is no need to raise the transfer belt 24 by the auxiliary separating device 40 and therefore the auxiliary separating device 40 is in a stand-by state at the retracted (accommodated) position in which the auxiliary separating device 40 does not contact the transfer belt 24.

Incidentally, during the image formation, in the case where the recording material leading end is not detected by the jam detecting sensor 70 for a predetermined time or more although the recording material P is fed, the controller 50 executes an operation in the stop mode, thus stopping the operation of the image forming apparatus 10. At this time, the controller 50 obtains the position of the recording material P on the basis of detect timing and time counts of the recording material leading end and trailing end by using a plurality of recording material passing sensors provided along a conveyance path of the recording material P and then executes the operation in the stop mode depending on the position of the recording material P.

Further, with speed-up of the process speed of the image forming apparatus in recent years, inertia during emergency stop is increased. For this reason, during the image formation, in the case where the auxiliary separating device 40 is actuated for providing the waviness on the recording material P, when the auxiliary separating device 40 is immediately moved to the retracted position, and as shown in (e) of FIG. 2, winding of the recording material P about the curved surface of the transfer belt 24 by the separation roller 26 occurs.

In the case of the image forming apparatus 10, the transfer belt cleaning device 31 is present at an opposing position where it opposes the separation roller 26 and therefore it is difficult to remove the recording material P wound about at the curved surface of the transfer belt 24 by the separation roller 26 after the emergency stop.

Therefore, in the case where the operation enters the stop mode during the image formation when the auxiliary separating device 40 is located at the roller raised position shown in (a) of FIG. 4, stop of the transfer belt 24 while the auxiliary separating device 40 is kept at the roller raised position was proposed. However, in this case, stress continuously exerted on the transfer belt 24 after the stop of the transfer belt 24 is problematic. When the transfer belt 24 is left standing for a long time in this state, the transfer belt 24 is deformed and in the worst case, is not returned to an original state, so that improper attraction or the like occurs.

Further, also in the case where the auxiliary separating device 40 in the stand-by state at the roller retracted position shown in (b) of FIG. 4 for the above reason by accident although under the transfer condition in which the auxiliary separating device 40 is actuated, there arises a problem. By the inertia of the transfer belt 24, the conveyed recording material P enters the curved surface of the transfer belt and is wound about the curved surface while the auxiliary separating device 40 is kept at the roller retracted position to cause jam in the transfer belt cleaning device 31, so that the jammed recording material is not readily removed.

Therefore, in the following embodiments, in the stop mode of the image forming apparatus 10, the auxiliary separating device 40 is selectively actuated to obviate the stress after the stop of the transfer belt 24 while preventing the winding jam of the recording material P due to the inertia of the transfer belt 24.

Embodiment 1

FIG. 11 is a flow chart of control in the stop mode in Embodiment 1. Parts (a) and (b) of FIG. 12 are illustrations of operation timing of the auxiliary separating device.

The stop mode in this embodiment refers to a state in which the image forming apparatus is capable of effecting control even when the jam of the recording material P occurs and excludes the case where the image forming apparatus cannot effect control due to power failure or the like. When the operation in the stop mode in this embodiment is performed, as shown in (b) of FIG. 3, the associated members are separated and spaced at the secondary transfer portion N1 and the attraction portion N2 and then in a state in which the recording material P is further conveyed and is placed on the separation claw 29 at its leading end, the transfer belt 24 is stopped.

As shown in FIG. 7 with reference to FIG. 1, when abnormality is caused during the image formation, the controller which is an example of an execution portion executes the operation in the stop mode. In the operation in the stop mode, the transfer belt 24 is rotated in the state in which the transfer belt 24 is pushed up by the auxiliary separating device 40, and then the rotation of the transfer belt 24 is stopped. In the operation in the stop mode, the end roller 41 is projected outward to separate the recording material P from the transfer belt 24 and thereafter release of the projection of the end roller 41 and stop of the rotation of the transfer belt 24 are executed.

The jam detecting sensor 70 which is an example of a detecting means is capable of detecting the recording material P in the state in which the leading end is held by the separation claw 29. In the operation in the stop mode, the pushing-up by the auxiliary separating device 40 is released after the leading end of the recording material P enters the separation roller 26, and then the rotation of the transfer belt 24 is stopped after the jam detecting sensor 70 detects the leading end of the recording material P. In the operation in the stop mode, the pushing-up of the transfer belt 24 by the auxiliary separating device 40 is executed after the nip pressure at the secondary transfer portion N1 is released. In the operation in the stop mode, the attraction roller 28 is spaced from the transfer belt 24 and thereafter the pushing-up of the transfer belt 24 by the end roller 41 is executed.

In this embodiment, in the case where the recording material P is jammed between the transfer belt 24 and the separation claw 29, the rotation of the transfer belt 24 is immediately stopped without performing the pushing-up of the transfer belt 24 by the end roller 41.

In this embodiment, in the case where the recording material P is jammed at the secondary transfer portion N1, the rotation of the transfer belt 24 is stopped immediately without performing the pushing-up of the transfer belt 24 by the end roller 41.

In this embodiment, in the case where the rigidity of the recording material P is higher than a predetermined level, without performing the pushing-up of the transfer belt 24 by the end roller 41, the rotation of the transfer belt 24 is stopped after the leading end of the recording material P reaches the separation claw 29.

The controller 50 controls the operation position of the auxiliary separating device 40 in the operation in the stop mode. The controller 50 judges actuation/non-actuation of the auxiliary separating device 40 in the operation in the stop mode on the basis of Table 1 described above and then controls the emergency stop of the transfer belt 24 in accordance with the flow shown in FIG. 11. The controller 50 judges the actuation/non-actuation of the auxiliary separating device 40 in the operation in the stop mode on the basis of the basis weight information of the recording material P designated through the user operating portion 102. The controller 50 judges the actuation/non-actuation of the auxiliary separating device 40 in the operation in on the basis of the secondary transfer current value read by the transfer power source D9.

The controller 50 controls the contact and separation operation between the intermediary transfer belt 6 and the transfer belt 24. The controller 50 recognize the recording material P, in real time, from the leading end position information of the recording material P obtained by the recording material passing sensor provided in front of the registration roller 8 for feeding the recording material P, and recording material feeding timing and time count of the registration roller 8. As shown in (a) and (b) of FIG. 12, depending on the position of the recording material P, the operation position of the auxiliary separating device 40 and timing of the contact and separation operation of the transfer belt 24 are controlled. In FIG. 12, (a) shows the control during the image formation, and (b) shows the control in the operation in the stop mode.

The controller 50 places the auxiliary separating device 40 at the position in which the waviness is generated on the transfer belt 24 until the recording material leading end passes through the separation claw 29 and is detected by the jam detecting sensor 70 even during the emergency stop of the image forming apparatus 10. Then at the time when the recording material leading end passes through the separation claw 29 and the separation of the recording material P from the transfer belt 24 is ensured with reliability even when there is no waviness on the recording material P, the auxiliary separating device 40 is moved to the position in which the waviness is not generated on the transfer belt 24.

By performing such an operation in the stop mode, the waviness is provided on the recording material P and thus the recording material P is separated from the transfer belt 24 with reliability, so that the winding jam at the separation portion of the transfer belt 24 during the emergency stop is prevented.

As shown in FIG. 11, when the jam of the recording material P is detected (S21), the controller 50 interrupts the image formation and forcedly executes the operation in the stop mode and as shown in (b) of FIG. 3, immediately releases the control at the secondary transfer portion N1 and the attraction portion N2 (S22).

The operation in the stop mode in Embodiment aims at introduction of the recording material P, which does not cause jam on the transfer belt 24, to the position in which the recording material P can be easily taken out and aims at prevention of an occurrence of secondary recording material jam due to inertial rotation during the stop of the transfer belt 24. For this reason, the operation in the stop mode in this embodiment is executed in response to the recording material jam in the conveyance path from the recording material cassette 15 to the registration roller 8 and the recording material jam occurring at positions from the fixing device to an unshown post-processing device via a discharging portion.

On the other hand, in the case where the jam of the recording material P occurs at the secondary transfer portion N1, the operation in the stop mode in this embodiment is not executed. With an increase of the rotation of the transfer belt 24, the status becomes serious and therefore the rotation of the transfer belt 24 is stopped immediately. Further, when creases are generated on the recording material P at the secondary transfer portion N1, the separation of the recording material P from the transfer belt 24, i.e., jam clearance by the user becomes easy, so that the user is not required to rely on the auxiliary separating device 40.

Further, also in the case where the recording material P causes jam between the transfer belt 24 and the separation claw 29, the operation in the stop mode in this embodiment is not executed. In this case, the operation is too late and therefore the rotation of the transfer belt 24 is stopped without performing the pushing-up of the transfer belt 24 by the end roller 41.

The controller 50 obtains, as shown in (b) of FIG. 12, the basis weight of the recording material P by turning on the secondary transfer bias during the image formation. After the operation in the stop mode is started, the operation of the auxiliary separating device 40 is judged on the basis of the obtained basis weight of the recording material P (S23).

In the case of stiff (rigid) recording material P with the basis weight exceeding 60 g/m$^2$ (>60 g/m$^2$ of S23), the auxiliary separating device 40 is kept at the accommodated position shown in (b) of FIG. 4 and the raising (pushing-up) operation of the transfer belt 24 is not performed (S29). However, in the case where the recording material P has the basis weight of less than 40 g/m$^2$ and has extremely low stiffness (<40 g/m$^2$ of S23), the auxiliary separating device 40 is moved in the Y1 direction to transfer the transfer belt 24 to the raised state as shown in (a) of FIG. 4 (S26).

In the case where the basis weight of the recording material P is in the range of 40 g/m$^2$ to 60 g/m$^2$ (40-60 g/m$^2$ of S23), the controller 50 judges, on the basis of the secondary transfer current value read during the image formation (S24), the operation of the auxiliary separating device 40 (S25).

The controller 50 rotates, when the secondary transfer current value is 40 μA or more (≥40 μA of S25), the auxiliary separating device 40 in the Y1 direction to transfer the transfer belt 24 to the raised state as shown in (a) of FIG. 4 (S26). However, when the secondary transfer current value is less than 40 μA (<40 μA of S25), the auxiliary separating device 40 is kept at the roller retracted position as it is and there is no such operation to raise the transfer belt 24 as shown in (b) of FIG. 4 (S29).

Under the condition in which it is difficult to separate the recording material P at the curved surface of the transfer belt 24 by the separation roller 26, as described above, the controller 50 moves the auxiliary separating device 40 to the roller raised position as shown in (a) of FIG. 4, so that the auxiliary separating device 40 assists the separation of the thin paper from the transfer belt 24.

Thereafter, when the leading end of the recording material P reaches the separation claw 29 and is detected by the jam detecting sensor 70 (YES of S28), a signal for performing an operation for retracting (accommodating) the auxiliary separating device 40 is sent from the controller 50 to the auxiliary separating device 40 (S29). The auxiliary separating device 40 receives the signal and then is moved from the roller raised position, where the transfer belt 24 is raised, to the roller retracted position where the transfer belt 24 and the auxiliary separating device 40 are separated (S29).

Similarly as during the image formation, in the case of the condition of "Not-raised (the roller raising operation is not performed" in Table 1, with no assistance of the auxiliary separating device 40, the recording material P is curvature-separated from the transfer belt 24 and reaches the separation claw 29. For this reason, the auxiliary separating device 40 is moved to the roller retracted position, as shown in (b) of FIG. 4, in which the auxiliary separating device 40 does not contact the transfer belt 24. The pushing up of the transfer belt 24 by the auxiliary separating device 40 is released.

As shown in (b) of FIG. 12, in the case where the auxiliary separating device 40 has already pushed up the transfer belt 24 at the time of starting the operation in the stop mode in this embodiment (NO of S28), as shown in (a) of FIG. 4, the pushed-up state is maintained (S26). Then, when the leading end of the recording material P is detected by the jam detecting sensor 70 and normal separation of the recording material P from the transfer belt 24 is confirmed (YES of S28), an operation signal for releasing the pushing-up by the auxiliary separating device 40 is sent from the controller 50.

As a result, the auxiliary separating device 40 is moved to the roller retracted position in which the auxiliary separating device 40 is spaced from the transfer belt 24 (S29) and thereafter the transfer belt 24 is stopped (S30). This state is shown in (b) of FIG. 4. As shown in FIG. 1, the recording material P stopped on the transfer belt 24 is separated and removed from the transfer belt 24 through a space created by retracting the fixing device 13 in the recording material conveyance direction.

By the above operation, during the emergency stop due to the jam occurrence or the like, it is possible to prevent the winding jam at the position of the separation roller 26 and processing of the recording material P remaining on the transfer belt 24 is facilitated.

Embodiment 2

FIG. 13 is an illustration of operation timing of an auxiliary separating device in an operation in a stop mode in Embodiment 2. Parts (a) to (c) of FIG. 14 are illustrations of the operation of the auxiliary separating device in this embodiment. In this embodiment, in the image forming apparatus 10, the case where the operation in the stop mode as shown in FIG. 11 is started with timing somewhat earlier than that in Embodiment 1 will be described.

As shown in FIG. 13, also in the case where the operation in the stop mode is started in the state in which the auxiliary separating device 40 is located at the roller retracted position, when the above-described "Raised" condition in Table 1 is satisfied, the auxiliary separating device 40 is moved to the roller raised position. In this case, the operation of the auxiliary separating device 40 and the timing of the contact and separation operation of the transfer belt 24 are shown in FIG. 13.

As shown in (a) of FIG. 14, there is the case where the leading end of the recording material P does not reach the position, in which the transfer belt 24 is pushed up by the auxiliary separating device 40, during the emergency stop due to the jam occurrence or the like. In this case, as shown in (b) of FIG. 14, the auxiliary separating device 40 is moved to the roller raised position and then the recording material P is conveyed by the transfer belt 24. Then, as shown in FIG. 8, when the recording material P is normally separated from the transfer belt 24 by the jam detecting sensor 70 located downstream of the separation claw 29, the controller 50 returns the auxiliary separating device 40 to the roller retracted position as shown in (b) of FIG. 4. As a result, the transfer belt 24 and the end roller 41 are placed in a spaced state and thereafter the transfer belt 24 is stopped. The state at this time is shown in (c) of FIG. 14.

By the above operation, during the emergency stop due to the jam occurrence or the like, it is possible to prevent the winding jam at the position of the separation roller 26 and processing of the recording material P remaining on the transfer belt 24 is facilitated.

Embodiment 3

FIG. 15 is a top plan view of a recording material conveyance state by the transfer belt. FIG. 16 is an illustration of operation timing of an auxiliary separating device in an operation in a stop mode in Embodiment 3. In this embodiment, in the image forming apparatus 10, the case where the operation in the stop mode as shown in FIG. 11 is started with the image is continuously formed by feeding the recording material with a short conveyance interval will be described.

As shown in FIG. 5, during the continuous image formation under the "Raised" condition shown in Table 1, a recording material P1 is conveyed in an arrow R3 direction and then with a short interval (sheet interval), the leading end of a subsequent recording material P2 is also conveyed onto the transfer belt 24. In this embodiment, the image forming apparatus 10 is in a continuous sheet passing state and therefore at the time of start of the operation in the stop mode, the second recording material P2 is in a state in which it leading end remains on the transfer belt 24.

Here, the recording materials P1 and P2 is A5-sized sheet (paper) with the basis weight of 40-60 g/m$^2$ and are in an environment condition such that the recording materials are not separated from the transfer belt 24 when the auxiliary separating device 40 is not actuated. The transfer belt 24 has a size such that a width is 330 mm and a center distance between the entrance roller 25 and the separation roller 26 is 250 mm. Further, the sheet interval between the recording materials P1 and P2 is 30 mm.

As shown in (a) of FIG. 16, it is assumed that the recording material jam occurs and then the operation in the stop mode is started. In this case, there is a possibility that the recording material P1 causes the winding jam at the separation portion of the separation roller 26. Further, the attraction power source D28 applies a negative attraction voltage to the attraction roller 28 to negatively charge the recording material P. For this reason, an attraction force between the transfer belt 24 and a portion of the recording material P1 passing through the secondary transfer portion N1 during the jam occurrence is larger than that between the transfer belt 24 and the recording material P1 at the attraction portion N2. Therefore, there is further increasing possibility that the recording material P1 causes the winding jam at the separation portion of the separation roller 26.

Therefore, in this embodiment, in the case where the leading end of the recording material P1 has passed through the secondary transfer portion N1 at the time of the jam occurrence, as shown in (b) of FIG. 14, the auxiliary separating device 40 is moved to the roller raised state to ensure the separation of the recording material P1 from the transfer belt 24 with reliability. Then, as shown in (c) of FIG. 14, the transfer belt 24 is stopped in the state in which only the recording material P1 is separated from the transfer belt 24. In this case, the subsequent recording material P2 is to be removed from the registration roller 8 located upstream of the attraction portion N2.

Embodiment 4

As shown in FIG. 1, in the operation in the stop mode in Embodiment 3, the first recording material P is sent into the fixing device 13 and then the transfer belt 24 may also be stopped at the position in which the leading end of the subsequent recording material P2 reaches the separation claw 29.

As shown in (b) of FIG. 16, in Embodiment 4, the auxiliary separating device 40 is kept in the roller raised state from the passing of the recording material P1 until the leading end of the subsequent recording material P2 is completely separated. Then, the transfer belt 24 is stopped with timing when the leading end of the subsequent recording material P2 passes through the separation claw 29 and is detected by the jam detecting sensor 70. At the substantially same time, the auxiliary separating device 40 is moved to the roller retracted position.

By the above operation, during the emergency stop due to the jam occurrence or the like, it is possible to prevent the winding jam at the position of the separation roller 26 and processing of the recording material P remaining on the transfer belt 24 is facilitated.

As described above, according to the image forming apparatus of the present invention, even when the recording material which is not readily separated from the belt member remains on the belt member during the operation in the stop mode, stability of the removal of the recording material from the belt member can be enhanced.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 280197/2010 filed Dec. 16, 2010, which is hereby incorporated by reference.

What is claimed is:

1. An image forming apparatus comprising:

an image bearing member;

a stretched rotatable belt member;

transfer means for forming a transfer portion where a toner image is transferred from said image bearing member onto a recording material carried and conveyed on said belt member;

a separation roller, which stretches said belt member, capable of separating the recording material from said belt member;

push-up means, provided upstream of said separation roller and downstream of the transfer portion with respect to a rotational direction of said belt member, capable of pushing up a belt surface locally with respect to a widthwise direction of said belt member to separate the recording material from said belt member; and an execution portion for executing, when abnormality occurs during an image forming operation, an operation in a stop mode in which said belt member is, after the image forming operation is stopped, rotated in a push-up state of said push-up means and then the rotation of said belt member is stopped.

2. The apparatus according to claim 1, further comprising:

a guiding member for guiding a leading end of the recording material separated from said belt member and capable of keeping a separation state; and a detecting member capable of detecting the recording material in a state in which the leading end of the recording material is held by said guiding member, wherein said execution portion releases pushing-up by said push-up means after the leading end of the recording material enters said separation roller in the stop mode and then stops, after said detecting member detects the leading end of the recording material, the rotation of said belt member.

3. The apparatus according to claim 2, wherein said execution portion immediately stops, when the recording material causes a jam between said belt member and said guiding member, the rotation of said belt member without pushing up said push-up means.

4. The apparatus according to claim 2, wherein when rigidity of the recording material is higher than a predetermined level, said execution portion stops the rotation of said belt member without pushing up said push-up means in a state in which the leading end of the recording material reaches said guiding member.

5. The apparatus according to claim 1, wherein at the transfer portion, nip pressure applied to the recording material is releasable, and wherein said execution portion pushes up, after the nip pressure at the transfer portion is released in the stop mode, said push-up means.

6. The apparatus according to claim 1, further comprising:

charging means, provided contactable to and separable from an outer surface of said belt member, for electrically attracting the recording material to said belt member while sandwiching the recording material conveyed to the transfer portion between itself and said belt member during image formation, wherein said execution portion pushes up said push-up means after said charging means is separated from said belt member in the stop mode.

7. The apparatus according to claim 1, wherein said execution portion immediately stops, when the recording material causes a jam at the transfer portion, the rotation of said belt member without pushing up said push-up means.

* * * * *